US008967068B2

(12) United States Patent
Yang

(10) Patent No.: US 8,967,068 B2
(45) Date of Patent: Mar. 3, 2015

(54) FLOATING OFFSHORE PLATFORM AND CENTRALIZED OPEN KEEL PLATE

(75) Inventor: Chan Kyu Yang, Katy, TX (US)

(73) Assignee: Technip France, Courbevoie (FR)

( * ) Notice: Subject to any disclaimer, the term of this patent is extended or adjusted under 35 U.S.C. 154(b) by 238 days.

(21) Appl. No.: 13/534,457

(22) Filed: Jun. 27, 2012

(65) Prior Publication Data

US 2014/0000502 A1 Jan. 2, 2014

(51) Int. Cl.
*B63B 35/44* (2006.01)

(52) U.S. Cl.
USPC ..... 114/265; 114/122

(58) Field of Classification Search
CPC ..... B63B 2039/067
USPC ..... 114/122, 264, 265; 405/224
See application file for complete search history.

(56) References Cited

U.S. PATENT DOCUMENTS

| | | | | |
|---|---|---|---|---|
| 3,673,974 | A * | 7/1972 | Harper | 114/265 |
| 3,986,471 | A * | 10/1976 | Haselton | 114/265 |
| 6,652,192 | B1 | 11/2003 | Xu et al. | |
| 6,718,901 | B1 | 4/2004 | Abbott et al. | |
| 7,156,040 | B2 | 1/2007 | Merchant et al. | |
| 7,219,615 | B2 | 5/2007 | Merchant et al. | |
| 7,900,572 | B2 * | 3/2011 | Leverette | 114/264 |
| 2002/0041795 | A1 | 4/2002 | Russell et al. | |
| 2008/0115714 | A1 | 5/2008 | Tahar et al. | |
| 2009/0205554 | A1 | 8/2009 | Srinivasan | |
| 2012/0034034 | A1 | 2/2012 | Xu | |

OTHER PUBLICATIONS

Gardel, A., International Search Report for International Patent Application No. PCT/US2013/042755, dated Aug. 26, 2013, European Patent Office.

Gardel, A., Written Opinion for International Patent Application No. PCT/US2013/042755, dated Aug. 26, 2013, European Patent Office.

* cited by examiner

*Primary Examiner* — Edwin Swinehart
(74) *Attorney, Agent, or Firm* — Locke Lord LLP

(57) ABSTRACT

The disclosure reduces vertical movement of a floating offshore platform by including a centralized open keel plate coupled to the hull that allows water below and above the keel plate. As the floating platform moves vertically, the keel plate separates the water and causes drag on the platform. The water moving vertically with the plate also increases the dynamic mass. The drag results in less vertical movement of the offshore platform without the need to extend legs of the platform to gain an equivalent reduction in vertical movement. The added dynamic mass increases the natural period of the vertical motion away from the wave excitation period to minimize the wave driven motion. The keel plate generally is above or at the same level of the keel, and therefore would not reduce the clearance between the seabed and the keel of the hull at the quayside.

12 Claims, 4 Drawing Sheets

FLOATING OFFSHORE PLATFORM AND CENTRALIZED OPEN KEEL PLATE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure relates a method and a system for reducing the vertical motions on floating platforms for drilling and production. More particularly, the present disclosure relates to floating platforms used in the exploration and production of offshore oil and gas, and more particularly to a semisubmersible floating platform having a keel plate to function as a heave plate.

2. Description of the Related Art

With the significantly increasing demand on the oil and gas supply, offshore exploration and production from reservoirs has become vital to such supply. These reservoirs usually require large drilling rigs and variable payloads which result in very large topsides in both size and weight. Large and expensive supporting offshore platforms are needed. However, the expense of such platforms can be decreased by building such a floating structure near or on shore and towing the structure to the intended offshore site.

Among the main types of offshore platforms designed for deep water, including the popular Spar, a type of platform is known as a semi-submersible platform. The structure is built near shore or onshore, floated to the offshore site, and partially submerged using ballast tanks to provide stability to the structure. Semi-submersibles are typically configured with large buoyant pontoon structures below the water surface and slender columns passing through the water surface supporting a topsides deck at a significant height above the water surface. Semi-submersible platforms make large and cost effective platforms for drilling and production of offshore oil and gas. However, because the structure has a relatively large floating surface, one challenge is restricting movement caused by wave and wind action to provide a desired stability for operations.

Heave plates have been used to stabilize movement of the semi-submersible platforms. The heave plate can be a solid plate or a constructed assembly of a plurality of plates that form a box to form a relatively large horizontal surface area, but is relatively thin vertically. The heave plate is mounted to the semi-submersible platform below the water surface and below at least a portion of the wave-influenced water zones. The heave plate increases the hydrodynamic mass of the offshore platform, where hydrodynamic mass is a measure of the amount of a fluid moving with a body that accelerates in the fluid and depends on the shape of the body and the direction of its motion. The heave plate at the lower depths provides additional resistance to vertical and tilting motion that would otherwise occur near or at the water surface. Thus, designers are motivated to mount the heave plate at deeper levels. However, the depth is initially limited, because the platform is built near or on shore at shallow depths. Thus, some systems have a lowering capability to the heave plate. The heave plate can be lowered to a more desirable depth after the platform is in position at the intended offshore site. Examples of such systems are illustrated, for example, in U.S. Pat. No. 6,652,192, U.S. Pat. No. 7,219,615 (as a continuation of U.S. Pat. No. 7,156,040), and U.S. Pat. No. 6,718,901, and are incorporated by reference herein. Each of these systems discloses lowering the heave plate to a depth below the platform after being located to the intended offshore site.

U.S. Pat. No. 6,652,192 discloses a heave suppressed, floating offshore drilling and production platform having vertical columns, lateral trusses connecting adjacent columns, a deep-submerged horizontal plate supported from the bottom of the columns by vertical truss legs, and a topside deck supported by the columns. The lateral trusses connect adjacent columns near their lower end to enhance the structural integrity of the platform. During the launch of the platform and towing in relatively shallow water, the truss legs are stowed in shafts within each column, and the plate is carried just below the lower ends of the columns. After the platform has been floated to the deep water drilling and production site, the truss legs are lowered from the column shafts to lower the plate to a deep draft for reducing the effect of wave forces and to provide heave and vertical motion resistance to the platform. Water in the column shafts is then removed for buoyantly lifting the platform so that the deck is at the desired elevation above the water surface.

U.S. Pat. No. 7,219,615 discloses a semi-submersible vessel having a pair of vertically spaced pontoons with varied buoyancy. The lower pontoon is retained in a close vertical proximity to the upper pontoon when the vessel is in transit. The lower pontoon is ballasted at the deployment site, dropping the pontoon to a depth of about 32 meters below the first pontoon baseline. As a result, stability and motion characteristics of the vessel are significantly improved.

While each of these systems offer solutions for a stabilized platform having a lowered heave plate, in practice the supporting structure for the heave plate to the platform may suffer from rigidity challenges. For example, U.S. Pat. No. 7,219,615 discloses extendable legs. Due to the extendable nature of the legs, no diagonal bracing between legs is shown that would be able to resist twisting and bending of the extended support structure to the heave plate, because diagonal bracing between the legs would apparently interfere with extending and retracting the legs through the guides. U.S. Pat. No. 6,652,192 illustrates extendable trusses within columns having diagonal flexible cable bracing installed between trusses after extension of the legs. Due to an interference between the truss diagonal members and the column, it is hard to design a receptacle which can enclose the truss legs and rigid diagonal bracing for effective support and load transfer. The patent does not disclose rigid bracing between trusses for the same reason, namely, the rigid bracing between the trusses would appear to interfere with extending and retracting the trusses. Another example includes U.S. Pat. No. 6,718,901 that discloses extendable legs so that deploying an offshore oil and gas production platform comprises placing a buoyant equipment deck on a buoyant pontoon so that elongated legs on the pontoon, each comprising a buoyant float, extend movably through respective openings in the deck. Chains extending from winches on the deck are reeved through fairleads on the pontoon and connected back to the deck. The chains are tightened to secure the deck to the pontoon for conjoint movement to an offshore location. The chains are loosened and the pontoon and leg floats ballasted so that the pontoon and leg floats sink below the floating deck. A further example of the extending draft concept is seen in US Publ. No. 20020041795.

Further, a deep draft semisubmersible usually needs to have larger than a 60 m draft to have the favorable motion to support the connections to the sea floor in harsh sea states. With this deep draft semisubmersible, the topside integration at the quayside and the transition from the fabrication yard to the installation site become problematic, because the column is too high to stabilize the platform during the transition mode. Many designs solve this difficulty by extending the draft that requires the significant risk of offshore installation operation.

There remains a need for a different system and method for a floating offshore platform having an improved stabilization of the offshore platform.

BRIEF SUMMARY OF THE INVENTION

The disclosure provides improved performance and reduces vertical movement of a floating offshore platform by including a centralized open keel plate coupled to the hull that allows water below and above the keel plate. As the floating platform moves vertically, the keel plate separates the water and causes drag on the platform. The water moving vertically with the plate also increases the dynamic mass. The drag results in less vertical movement of the offshore platform without the need to extend legs of the platform to gain an equivalent reduction in vertical movement. The added dynamic mass increases the natural period of the vertical motion away from the wave excitation period to minimize the wave driven motion. As a result, the vertical motion of the platform can be reduced compared to a platform without the keel plate. The keel plate can be coupled to the hull during fabrication at the yard. The keel plate generally is above or at the same level of the keel, and therefore would not reduce the clearance between the seabed and the keel of the hull at the quayside. Therefore, the keel plate can provide enough stability and buoyancy for quayside integration and for the transition from the fabrication yard to the installation site.

The disclosure provides a floating offshore platform, comprising: a floating hull comprising: a plurality of vertically extending columns; a plurality of pontoons coupled to the vertically extending columns that are configured to be disposed at least partially below a surface of water in which the offshore platform is disposed; and further comprising a keel plate disposed in a central open area of the hull, the keel plate being configured to be disposed at least partially below a surface of water in which the offshore platform is disposed, and having a gap between at least a portion of an outer perimeter of the keel plate and an inner perimeter of the hull.

The disclosure also provides a method of stabilizing a floating offshore platform, the offshore platform having a floating hull comprising a plurality of vertically extending columns and a plurality of pontoons coupled to the vertically extending columns that are configured to be disposed at least partially below a surface of water in which the offshore platform is disposed; and a keel plate disposed in a central open area of the hull below a surface of water and having a gap between at least a portion of an outer perimeter of the keel plate and an inner perimeter of the hull, the method comprising: allowing the offshore platform to float in water; and allowing water to flow through the gap between the outer perimeter of the keel plate and the inner perimeter of the hull to cause water separation around the outer perimeter of the keel plate upon the offshore platform moving vertically in response to a sea wave.

DETAILED DESCRIPTION

Figure 1:
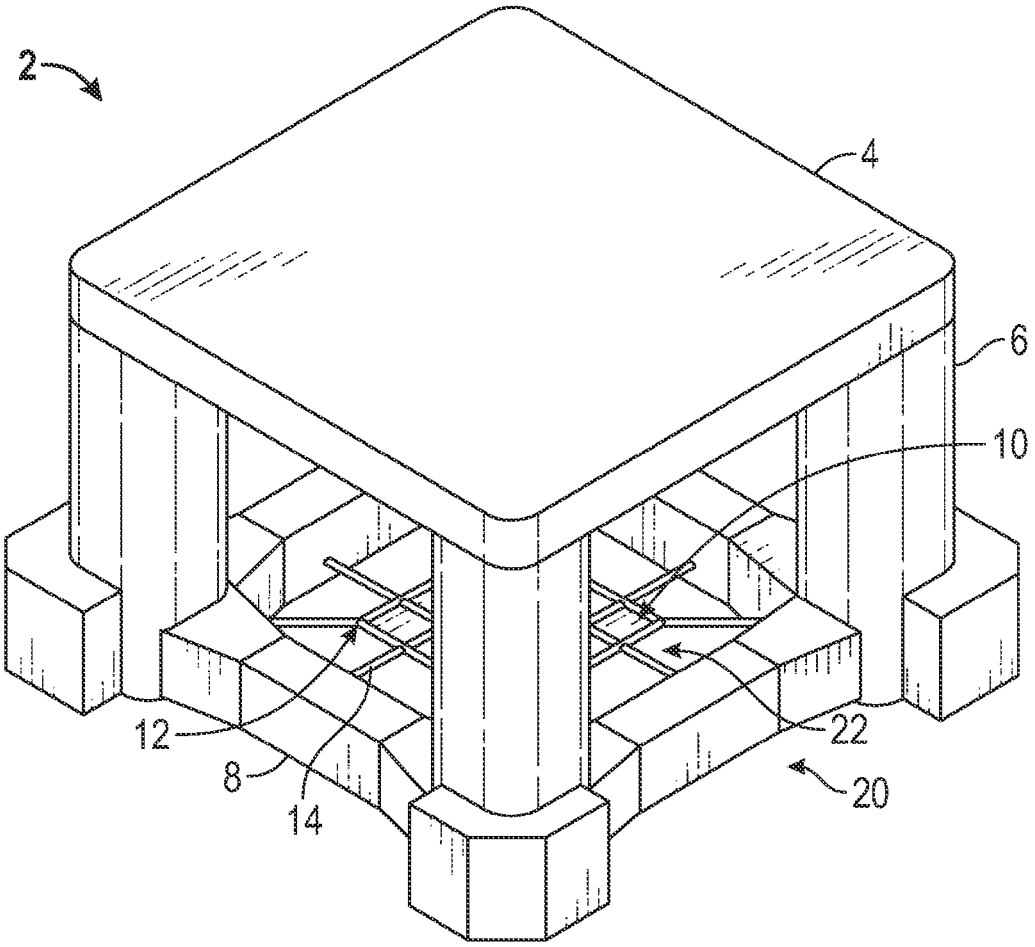
FIG. 1 is a schematic perspective view of an exemplary embodiment of a floating offshore platform having a keel plate.

The Figures described above and the written description of specific structures and functions below are not presented to limit the scope of what Applicant has invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location, and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an alphabetic character after a number to reference a specific member of the numbered element to aid in describing the structures in relation to the Figures, but is not limiting in the claims unless specifically stated. When referring generally to such members, the number without the letter is used. Further, such designations do not limit the number of members that can be used for that function.

The disclosure provides improved performance and reduces vertical movement of a floating offshore platform by including a centralized open keel plate coupled to the hull that allows water below and above the keel plate. As the floating platform moves vertically, the keel plate separates the water and causes drag on the platform. The water moving vertically with the plate also increases the dynamic mass. The drag results in less vertical movement of the offshore platform without the need to extend legs of the platform to gain an equivalent reduction in vertical movement. The added dynamic mass increases the natural period of the vertical motion away from the wave excitation period to minimize the wave driven motion. As a result, the vertical motion of the platform can be reduced compared to a platform without the keel plate. The keel plate can be coupled to the hull during fabrication at the yard. The keel plate generally is above or at the same level of the keel, and therefore would not reduce the clearance between the seabed and the keel of the hull at the quayside. Therefore, the keel plate can provide enough stability and buoyancy for quayside integration and for the transition from the fabrication yard to the installation site.

Figure 2:
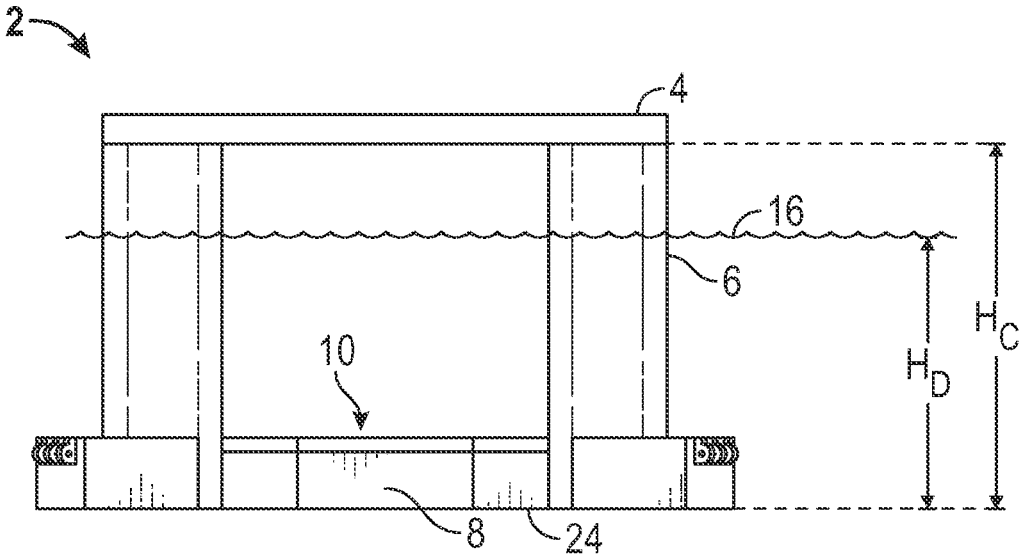
FIG. 2 is a schematic side view of the exemplary floating offshore platform with the keel plate.
Figure 3:
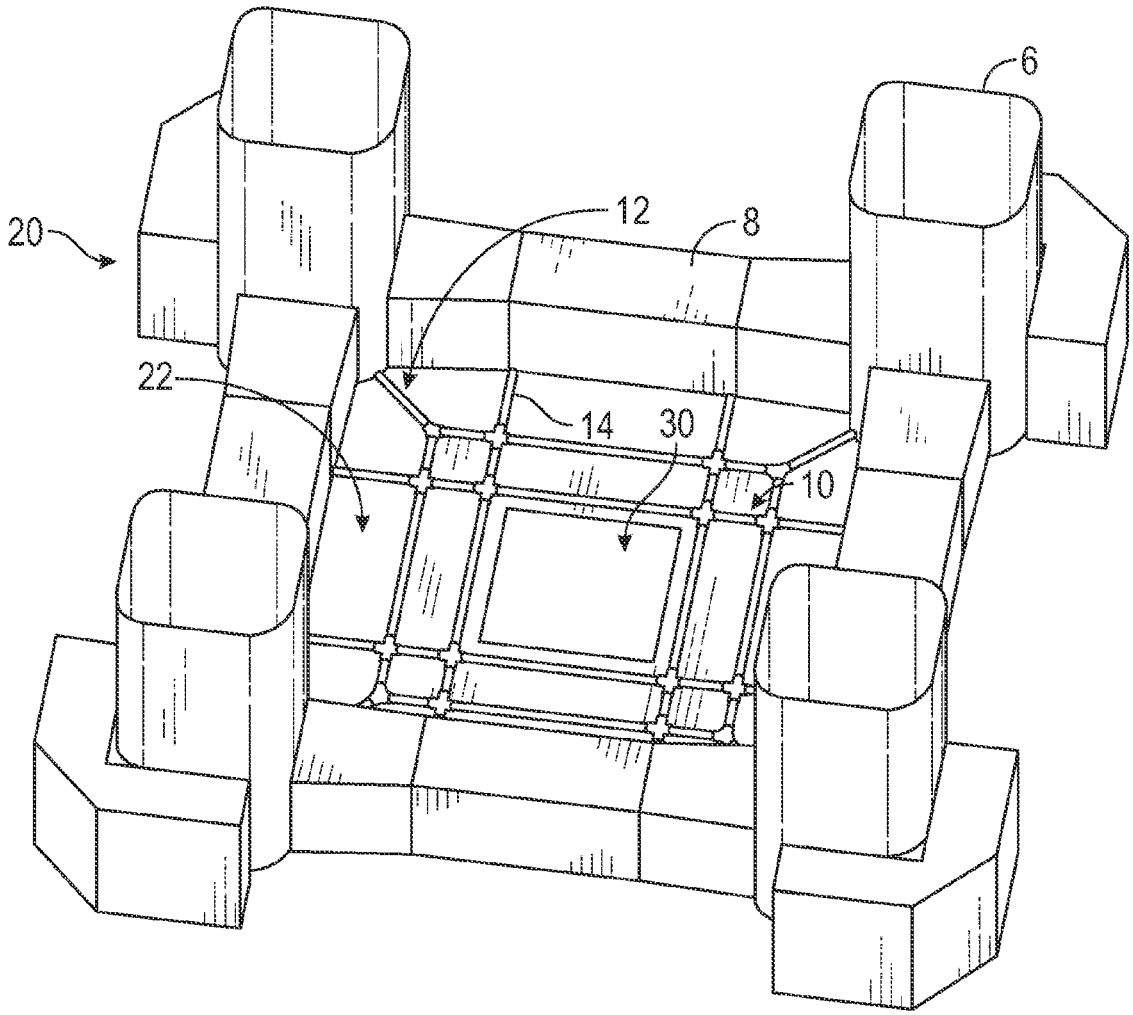
FIG. 3 is a schematic perspective cross sectional view of the floating offshore platform with the keel plate disposed in an open area between the pontoons, columns, or a combination thereof.
Figure 4:
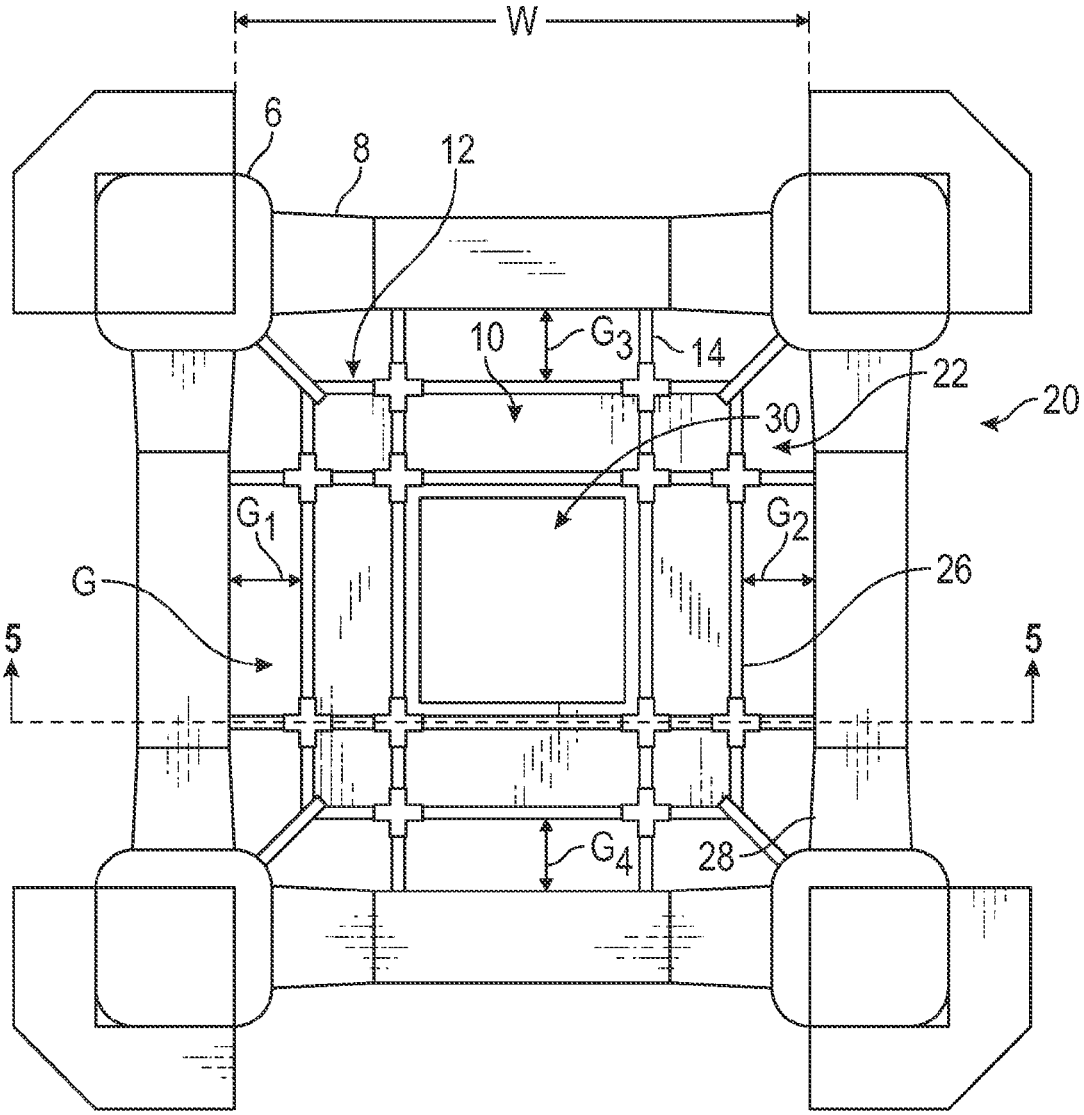
FIG. 4 is a schematic top cross sectional view of the floating platform with the keel plate.
Figure 5:
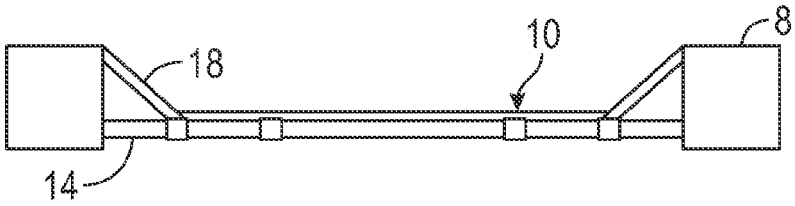
FIG. 5 is a schematic side cross sectional view of the floating platform with the keel plate.

FIG. 1 is a schematic perspective view of an exemplary embodiment of a floating offshore platform having a keel plate. FIG. 2 is a schematic side view of the exemplary floating offshore platform with the keel plate. FIG. 3 is a schematic perspective cross sectional view of the floating offshore platform with the keel plate disposed in an open area between the pontoons, columns, or a combination thereof. FIG. 4 is a schematic top cross sectional view of the floating platform with the keel plate. FIG. 5 is a schematic side cross sectional view of the floating platform with the keel plate. The figures will be described in conjunction with each other.

An exemplary floating offshore platform 2 generally includes a topsides 4 (also referenced a deck) that supports equipment, facilities, and operations for the offshore platform. The topsides 4 is coupled to a plurality of columns 6, generally at least three and often four columns. The columns 6 have a column height $H_C$ with a portion that is below a water level 16 to establish a draft height $H_D$. The columns can be at least partially buoyant and can be adjustable in their buoyancy. The columns 6 can be coupled to pontoons 8 disposed between two of more of the columns or below the columns where the pontoons would join and become a pontoon base. The columns 6 and pontoons 8 can be referenced herein as a hull 20. An open area 22 having a width W is created between the columns and the pontoons that is central to the offshore platform. (For rectangular and even-numbered, polygonal-shaped open areas, the width W would be the shortest cross sectional dimension across the shape. For triangular and other odd-numbered, polygonal-shaped open areas, the W would be the shortest cross sectional dimension of the shape, that is, the length measured along a perpendicular line from a side to an apex across the shape. For circular-shaped open areas, the width W would be the diameter. For elliptical-shaped open areas, the width would be the shorter minor axis.) The open area 22 is generally used to position risers to the seafloor (not shown) and other subsurface members.

The disclosure provides a keel plate 10 in the open area 22. The keel plate 10 is generally a plate as the term is normally used in the field, that is, having a large square area compared to a small thickness and is generally a non-buoyant structure. The keel plate 10 is generally oriented horizontally and located at the keel level inside the open area 22 of the hull 20. In at least one embodiment, the keel plate 10 can be centered in the open area 22. The keel plate 10 generally has one or more openings 30 through which risers and other subsurface connections can be made and are disposed generally toward the middle of the keel plate. The keel plate is shown as a square, but can have other geometric shapes as may be appropriate for the offshore platform, including triangular, rectangular, circular, elliptical, hexagonal, octagonal, and so forth. The keel plate 10 can be supported by a horizontal frame 12 with lateral braces 14 extending from the keel plate to the hull 20, such as to the columns 6 or pontoons 8. The lateral braces 14 can be positioned around the keel plate 10, including at one or more corners of the keel plate. The keel plate 10 can also be supported by vertical braces 18, shown in FIG. 5. In at least one embodiment, the horizontal frame 12 is below the keel plate 10, and the vertical braces 18 are disposed above the keel plate. In one embodiment, one end of the vertical braces 18 can be coupled to the horizontal frame 12 and the other end of the vertical braces to a top of a side of the pontoons 8 to maximize an angle between the horizontal frame and the vertical braces.

In at least one embodiment, the keel plate 10 and the frame 12 are coupled at or above the bottom 24 of the hull 20 of the offshore platform 2. The keel plate 10 can be installed during the fabrication process of the offshore platform at the fabrication yard. Thus, the keel plate and the frame do not decrease a bottom clearance during the wet tow or quayside integration of the topside 4.

Figure 6:
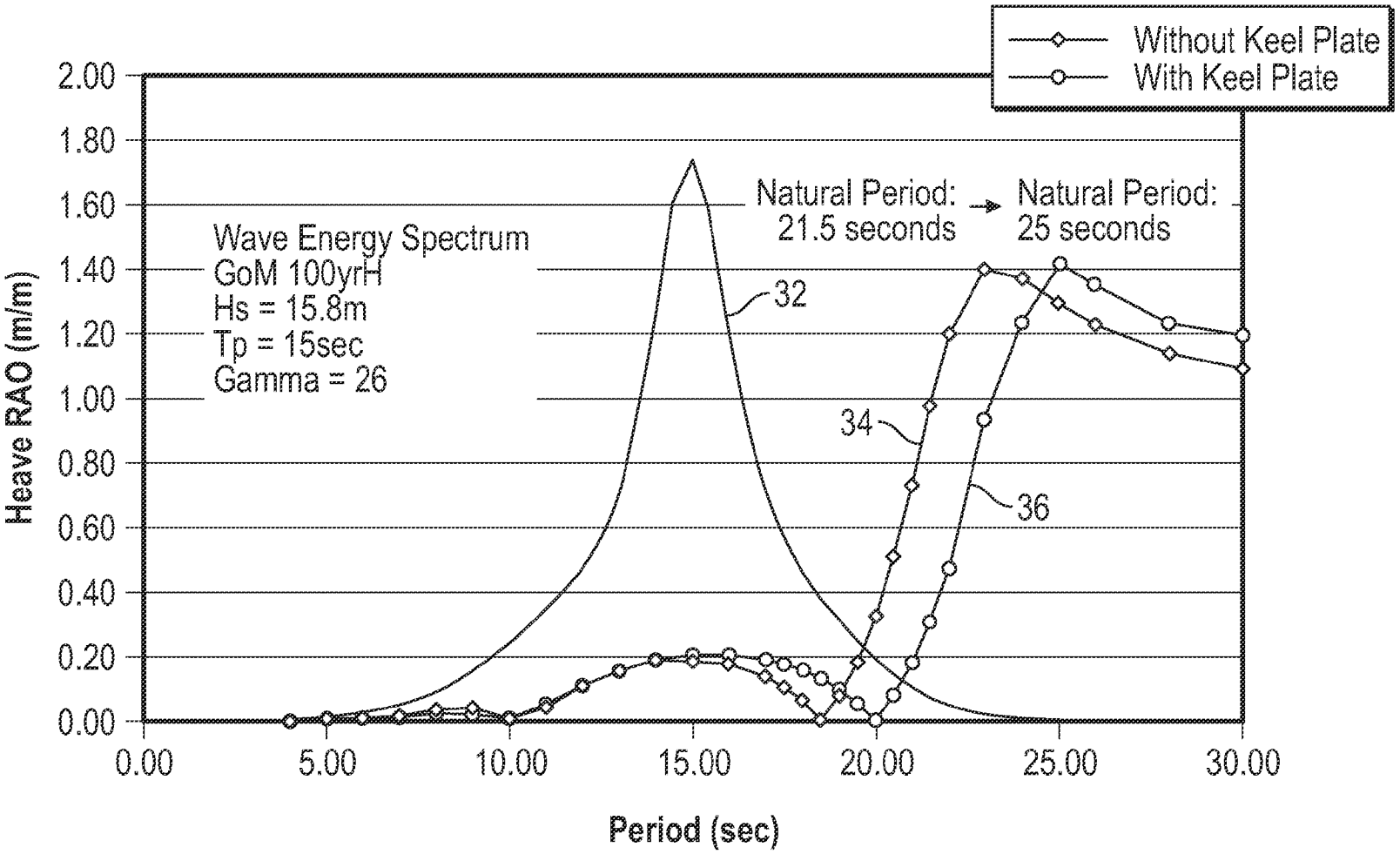
FIG. 6 is a chart of predicted effects of the keel plate on the offshore platform based on a typical design wave period, comparing a stabilized offshore platform with an unstabilized offshore platform.

The keel plate 10 is sized within the open area 22 to leave a gap G between an outer perimeter 26 of the keel plate and an inner perimeter 28 of the hull 20, namely, the inner perimeter formed by the pontoons, or pontoons and columns, depending on the specific structure of the offshore platform. In at least one embodiment, the gap G can be at least 10% of the width W of the open area 22. In at least one embodiment, the gap G can be equal around the keel plate 10. However, in some embodiments, it may be that unequal gaps could be designed to effect a different result for various sides of the hull, that is, gaps $G_1$, $G_2$, $G_3$, and $G_4$ illustrated in FIG. 4 could be equal or unequal. The keel plate helps add dynamic mass from the water volume moving with the keel plate and thence to the platform during vertical movement of the platform. The gap G between the keel plate 10 and the hull 20 creates water separation around the edges of the keel plate, that is, the outer perimeter 26. The water separation dissipates the energy to generate drag during the platform movement. The added mass and the drag help reduce the wave-induced motion of the platform, such as in hurricanes in the Gulf of Mexico and other harsh sea states. The addition of the keel plate provides a better heave motion by increasing the natural period of a heave motion larger than the conventional deep draft semisubmersibles, as shown in FIG. 6. In addition, the size of the gap G and the opening 30 help tune the phase of the wave loads on the plate 10 and on the hull 20 to reduce the total wave loads at a critical wave period when the wave energy is maximum. For example, too small a gap can decrease the volume of water being separated and result in reduced effectiveness of the keel plate, but too small of a keel plate reduces the surface area available for water separation and can result in reduced effectively of the keel plate. The particular size and configurations can be modeled and/or experimentally determined by those with ordinary skill in the art, given the teachings and guidance provided herein.

FIG. 6 is a chart of predicted effects of the keel plate on an exemplary floating offshore platform based on a typical design wave period, comparing a stabilized offshore platform with an unstabilized offshore platform. The X-axis is the time in seconds of a wave period and the natural period of the offshore platform 2 without the keel plate 10 and with the keel plate. The Y-axis represents the response amplitude operator (RAO), a known term of art in vessel design for responding to the movement of the vessel in proportion to a wave height.

The curve 32 represents the wave energy spectrum having a peak period of $T_P$ of 15 seconds. The curve 34 represents the responsive natural period of an unstabilized floating offshore platform without a keel plate 10, where the natural period is 21.5 seconds at a 1.40 RAO. The curve 34 represents the responsive natural period of a stabilized floating offshore platform with a keel plate 10, where the natural period is 25.0 seconds at a 1.42 RAO. For this example, the keel plate modeling predicts an increase of the natural period of the offshore platform (and therefore decrease in response to a sea wave) with the keel plate by about 16% more than the offshore platform without the keel plate. Effectively, the keel plate lengthens the offshore platform period and the resonance of such period, so that the offshore platform is more stabilized and its movement is dampened at the design period. Thus, the offshore platform movement does not move in direct correlation to the wave passing by the offshore platform. FIG. 6 also indicates that a hump of the RAO around a 15-17 seconds wave period can be kept similar to the unstabiliized platform without the keel plate by tuning the sizes of the gap G and the center opening 30.

Other and further embodiments utilizing one or more aspects of the inventions described above can be devised without departing from the spirit of Applicant's invention. For example, it is possible to have different supporting structures and frames for the keel, the keel can be divided into portions that may or may not be contiguous, the keel can be located at different elevations below the water surface when in use, the gap spacing can be different proportions and distances, the floating offshore platform design can vary, the number of columns and pontoons and their shape and size can vary, and other variations in keeping with the scope of using a keel plate to stabilize the floating offshore platform.

Further, the various methods and embodiments described herein can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Apparent modifications and alterations to the described embodiments are available to those of ordinary skill in the art given the disclosure contained herein. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A floating offshore platform, comprising:

a floating hull comprising:

a plurality of vertically extending columns;

a plurality of pontoons coupled to the vertically extending columns that are configured to be disposed at least partially below a surface of water in which the offshore platform is disposed; and a keel plate disposed in a central open area of the hull between the pontoons, and one or more braces coupled between the keel plate and the pontoons, columns, or a combination thereof, the keel plate being configured to be disposed at least partially below a surface of water in which the offshore platform is disposed, and having a gap between at least a portion of an outer perimeter of the keel plate and an inner perimeter of the hull, the gap being measured between an outer perimeter of the keel plate and an inner perimeter of a pontoon in a direction perpendicular to the inner perimeter of the pontoon.

2. The offshore platform of claim 1, wherein the keel plate is configured to increase a wave period response of the offshore platform to a sea wave having a wave period compared to a wave period response of an offshore platform without the keel plate.

3. The offshore platform of claim 1, wherein the gap has a dimension of at least 10% of a smallest cross sectional width of the open area.

4. The offshore platform of claim 1, wherein the keel plate is coupled at or above the bottom of the hull.

5. The offshore platform of claim 1, wherein the keel plate is fixedly coupled to the offshore platform during fabrication at a fabrication yard.

6. A method of stabilizing a floating offshore platform, the offshore platform having a floating hull comprising a plurality of vertically extending columns and a plurality of pontoons coupled to the vertically extending columns that are configured to be disposed at least partially below a surface of water in which the offshore platform is disposed; and a keel plate disposed in a central open area of the hull between the pontoons, and one or more braces coupled between the keel plate and the pontoons, columns, or a combination thereof, the keel plate being configured to be disposed below a surface of water and having a gap between at least a portion of an outer perimeter of the keel plate and an inner perimeter of the hull, the gap being measured between an outer perimeter of the keel plate and an inner perimeter of a pontoon in a direction perpendicular to the inner perimeter of the pontoon, the method comprising:

allowing the offshore platform to float in water; and allowing water to flow through the gap between the outer perimeter of the keel plate and the inner perimeter of the hull to cause water separation around the outer perimeter of the keel plate upon the offshore platform moving vertically in response to a sea wave.

7. The method of claim 6, wherein allowing water to flow through the gap between the outer perimeter of the keel plate and the inner perimeter of the hull to cause water separation comprises reducing a wave period response of the offshore platform to a sea wave compared to a wave period response of an offshore platform without the keel plate.

8. The method of claim 6, wherein allowing water to flow through the gap comprises allowing the water to flow over the keel plate through the gap that is at least 10% of a smallest cross sectional width of the open area.

9. The method of claim 6, wherein allowing water to flow through the gap comprises allowing the water to flow over the keel plate while the keel plate is fixedly coupled at or above the bottom of the hull.

10. The offshore platform of claim 1, wherein the gap is formed around the perimeter of the keel plate.

11. The method of claim 6, wherein the gap is formed around the perimeter of the keel plate.

12. A floating offshore platform, comprising:

a floating hull comprising:

a plurality of vertically extending columns;

a plurality of pontoons coupled to the vertically extending columns that are configured to be disposed at least partially below a surface of water in which the offshore platform is disposed; and a keel plate disposed in a central open area of the hull between the pontoons, and one or more braces coupled between the keel plate and the pontoons, columns, or a combination thereof, the keel plate being configured to be disposed at least partially below a surface of water in which the offshore platform is disposed, and having a gap between at least a portion of an outer perimeter of the keel plate and an inner perimeter of the hull, the gap being measured along a shortest distance between the keel elate and a pontoon.

* * * * *